US008948640B2

(12) United States Patent
Takeuchi et al.

(10) Patent No.: US 8,948,640 B2
(45) Date of Patent: Feb. 3, 2015

(54) IMAGE FORMING APPARATUS

(71) Applicants: Kenji Takeuchi, Negoya (JP); Kei Ishida, Nagoya (JP); Kaoru Suzuki, Ichinomiya (JP); Yuki Fukusada, Kasugai (JP)

(72) Inventors: Kenji Takeuchi, Negoya (JP); Kei Ishida, Nagoya (JP); Kaoru Suzuki, Ichinomiya (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 73 days.

(21) Appl. No.: 13/761,212

(22) Filed: Feb. 7, 2013

(65) Prior Publication Data

US 2013/0202324 A1 Aug. 8, 2013

(30) Foreign Application Priority Data

Feb. 7, 2012 (JP) ..... 2012-023872

(51) Int. Cl.
*G03G 15/20* (2006.01)
*G03G 15/00* (2006.01)

(52) U.S. Cl.
CPC ..... *G03G 15/2039* (2013.01); *G03G 15/2046* (2013.01); *G03G 15/657* (2013.01); *G03G 2215/2035* (2013.01)
USPC ..... 399/68

(58) Field of Classification Search
CPC ..... G03G 2215/00599
USPC ..... 399/68
See application file for complete search history.

(56) References Cited

U.S. PATENT DOCUMENTS

| | | | | |
|---|---|---|---|---|
| 7,515,841 | B2 | 4/2009 | Kato et al. | |
| 7,813,660 | B2 * | 10/2010 | Takahashi et al. | 399/43 |
| 8,503,894 | B2 * | 8/2013 | Misawa | 399/33 |
| 2004/0190924 | A1 * | 9/2004 | Iwasaki et al. | 399/68 |
| 2007/0071475 | A1 * | 3/2007 | Blair et al. | 399/68 |
| 2007/0086817 | A1 | 4/2007 | Kato et al. | |

FOREIGN PATENT DOCUMENTS

JP 2007-108297 A 4/2007

* cited by examiner

*Primary Examiner* — Clayton E LaBalle
*Assistant Examiner* — Leon W Rhodes, Jr.
(74) *Attorney, Agent, or Firm* — Banner & Witcoff, Ltd.

(57) ABSTRACT

An image forming apparatus includes: a fixing device: having a heating member, a rotating member, and a temperature sensor; a sheet feeding unit; and a control device configured to perform a sheet feed control: in which the feeding timing is set to a first timing if the temperature gradient of the heating member for a predetermined period is larger than a first threshold value; and in which the feeding timing is set to a second timing later than the first timing if the temperature gradient of the heating member for the predetermined period is equal to or less than the first threshold value, and wherein, in the sheet feed control, the control device changes the first threshold value to a smaller value as the temperature of the heating member at the print-instruction receiving time increase.

19 Claims, 6 Drawing Sheets

<FIRST THRESHOLD VALUE>

| | HIGH ROTATION | LOW ROTATION |
|---|---|---|
| MEDIUM TEMPERATURE | A1 | A2 |
| LOW TEMPERATURE | A3 | A4 |

<SECOND THRESHOLD VALUE>

| | HIGH ROTATION | LOW ROTATION |
|---|---|---|
| MEDIUM TEMPERATURE | B1 | B2 |
| LOW TEMPERATURE | B3 | B4 |

IMAGE FORMING APPARATUS

CROSS-REFERENCE TO RELATED APPLICATION

This application claims priority from Japanese Patent Application No. 2012-023872 filed on Feb. 7, 2012, the entire subject matter of which is incorporated herein by reference.

TECHNICAL FIELD

This disclosure relates to an image forming apparatus including a fixing device for thermally fixing developer images onto recording sheets, and a control device for controlling the fixing device.

BACKGROUND

It is known that an image forming apparatus compares the rising state of the temperature of a heater in a fixing device with a predetermined threshold value, thereby determining the kind of a power supply voltage, and thus changes a sheet feeding timing according to the kind of the power supply voltage).

SUMMARY

However, in the background art, in a case where the temperature of the fixing device depends on environment, since the rising state of the fixing device changes, it is difficult to set the sheet feeding timing to an appropriate timing by the predetermined threshold value.

Accordingly, this disclosure provides at least an image forming apparatus capable of setting the sheet feeding timing of a recording sheet to an appropriate timing.

In view of the above, an image forming apparatus of this disclosure includes: a fixing device, a heat source configured to heat the heating member; a rotating member configured to rotate and to be in contact with the heating member, and a temperature sensor configured to detect the temperature of the heating member; a sheet feeding unit configured to feed a recording sheet toward the fixing unit; and a control device configured to control the heat source and the sheet feeding unit. The control device is configured perform a sheet feed control: in which the feeding timing of a first recording sheet by the sheet feeding unit is set to a first timing if the temperature gradient of the heating member for a predetermined period from a print-instruction receiving time is larger than a first threshold value; and in which the feeding timing of the first recording sheet by the sheet feeding unit is set to a second timing later than the first timing if the temperature gradient of the heating member for the predetermined period is equal to or less than the first threshold value, and wherein, in the sheet feed control, the control device changes the first threshold value to a smaller value as the temperature of the heating member at the print-instruction receiving time increase.

According to this configuration, the first threshold value is changed to a smaller value according to a phenomenon in which the temperature gradient of the heating member is reduced as the temperature of the heating member at the print-instruction receiving time increases. Therefore, it is possible to compare the temperature gradient of the heating member with the appropriate first threshold value, and it is possible to set the sheet feeding timing of the recording sheet to an appropriate timing.

Meanwhile, another aspect of an image forming apparatus of this disclosure includes: a fixing device, a heat source configured to heat the heating member; a rotating member configured to rotate and to be in contact with the heating member, and a sensor configured to detect the temperature of the heating member; a sheet feeding unit configured to feed a recording sheet toward the fixing unit; and a controller for feeding a sheet by the sheet feeding unit. The controller, upon feeding a sheet by the sheet feeding unit in response to receiving a print-instruction, is configured to: wait for a first interval before feeding a sheet if a gradient of the temperature detected by the sensor upon receiving a print-instruction is greater than a first threshold value; wait for a second interval longer than the first interval before feeding a sheet if a gradient of the temperature detected by the sensor upon receiving a print-instruction is equal or smaller than the first threshold value; and set the first threshold value based on the temperature detected by the sensor upon receiving a print-instruction.

According to this disclosure, it is possible to set the sheet feeding timing of the recording sheet to an appropriate timing.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Now, an illustrative embodiment of this disclosure will be described in detail with reference to appropriate drawings. In the following description, the general configuration of a laser printer 1 will be first described in brief as an example of an image forming apparatus according to the illustrative embodiment of this disclosure, and then a fixing device and a control device will be described in detail.

Figure 1:
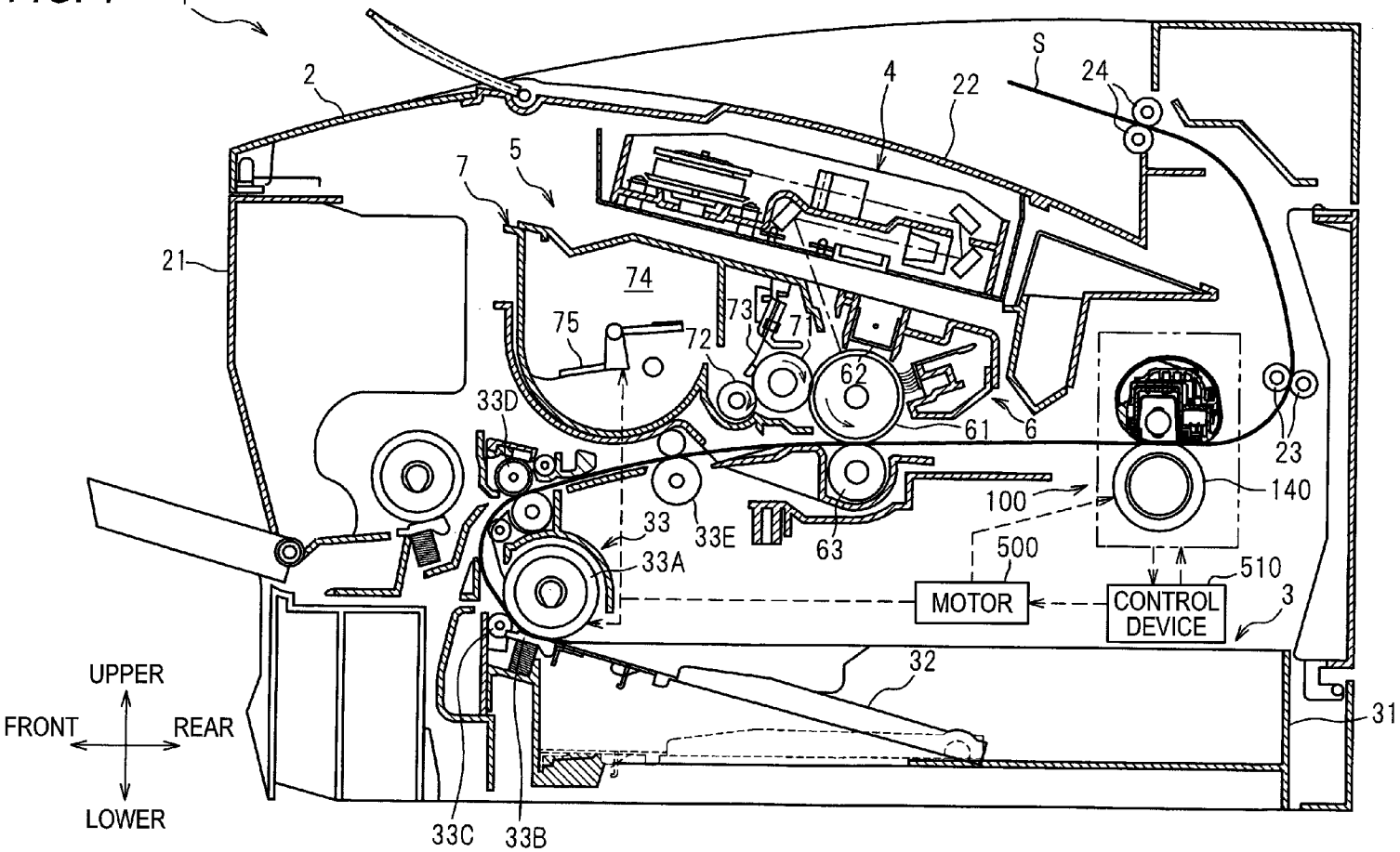
FIG. 1 is a cross-sectional view illustrating a laser printer according to an illustrative embodiment of this disclosure.

Also, in the following description, directions of the laser printer 1 refer to the directions as seen from a user facing to the laser printer during its use. To be more specific, referring to FIG. 1, a left-side direction and a right-side direction of the drawing sheet are referred to as a "front side" and a "rear side" of the laser printer, respectively. Also, a direction away from a viewer of FIG. 1 is referred to as a "left side", and a direction toward the viewer of FIG. 1 as a "right side". An upper and lower direction in FIG. 1 is referred to as an "upper-lower direction".

<General Configuration of Laser Printer>

As shown in FIG. 1, the laser printer 1 mainly includes a sheet feeding unit 3, an exposing device 4, a processing cartridge 5, and a fixing device 100 inside a main body casing 2. The sheet feeding unit 3 feeds a sheet S as an example of a recording sheet, the processing cartridge 5 transfers a toner image (developer image) onto the sheet S, and the fixing device 100 thermally fixes the toner image onto the sheet S.

The sheet feeding unit 3 is provided at the lower portion of the inside of the main body casing 2, and mainly includes a sheet feed tray 31, a sheet pressing plate 32, and a sheet feeding unit 33 which is an example of a sheet feeding unit. The sheet feeding unit 33 includes a sheet feeding roller 33A and a sheet feeding pad 33B for conveying sheets S in the sheet feed tray 31 to the downstream side (the downstream side in the conveyance direction of the sheets S), one by one, and paper dust removing rollers 33C and 33D which are provided on the downstream side relative to the sheet feeding roller 33A. Further, the sheet feeding unit 33 includes a registration roller 33E which is provided on the downstream side relative to the paper dust removing rollers 33C and 33D.

In this sheet feeding unit 33, the sheets S in the sheet feed tray 31 are brought near to the sheet feeding roller 33A by the sheet pressing plate 32, are fed by the sheet feeding roller 33A and the sheet feeding pad 33B, are passed various rollers 33C to 33E, and then are sent toward the process cartridge 5 and the fixing device 100.

The exposing unit 4 is disposed at the upper portion in the main body casing 2, and mainly includes a laser emission unit (not shown), a polygon mirror, lenses, reflective mirrors, and so on whose reference symbols are omitted. In the exposing unit 4, a laser beam (see a chain line) based on image data is emitted from the laser emission unit, and scans the surface of the photosensitive drum 61 at high speed, thereby exposing the surface of the photosensitive drum 61.

The process cartridge 5 is disposed below the exposing unit 4, and it is configured to be attachable and detachable with respect to the main body casing 2 from an opening shown when a front cover 21 provided to the main body casing 2 is open. The process cartridge 5 is configured by a drum unit 6 and a developing unit 7.

The drum unit 6 mainly includes the photosensitive drum 61, a charger 62, and a transfer roller 63. Also, the developing unit 7 is configured to be attachable and detachable with respect to the drum unit 6, and mainly includes a developing roller 71, a feeding roller 72, a layer-thickness regulating blade 73, a toner container 74 for containing toner (developer), and an agitator 75 for agitating the toner in the toner container 74.

In the process cartridge 5, the surface of the photosensitive drum 61 is uniformly charged by the charger 62, and then is exposed by high-speed scanning with the laser beam from the exposing unit 4, so that an electrostatic latent image based on the image data is formed on the photosensitive drum 61. Further, the toner in the toner container 74 is supplied to the developing roller 71 through the feeding roller 72, and enters into a gap between the developing roller 71 and the layer-thickness regulating blade 73, so as to be held as a thin layer having a constant thickness on the developing roller 71.

The toner held on the developing roller 71 is supplied from the developing roller 71 to the electrostatic latent image formed on the photosensitive drum 61. Therefore, the electrostatic latent image is visualized, that is, a toner image is formed on the photosensitive drum 61. Then, a sheet S is conveyed between the photosensitive drum 61 and the transfer roller 63, so that the toner image on the photosensitive drum 61 is transferred onto the sheet S.

The fixing device 100 is provided on the rear side relative to the process cartridge 5. The transferred toner image (toner) transferred on the sheet S passes through the fixing device 100, so that the toner image is fixed on the sheet S by heat. Then, the sheet S is discharged onto a sheet discharge tray 22 by conveyance rollers 23 and 24.

<Detailed Configuration of Fixing Device>

Figure 2:
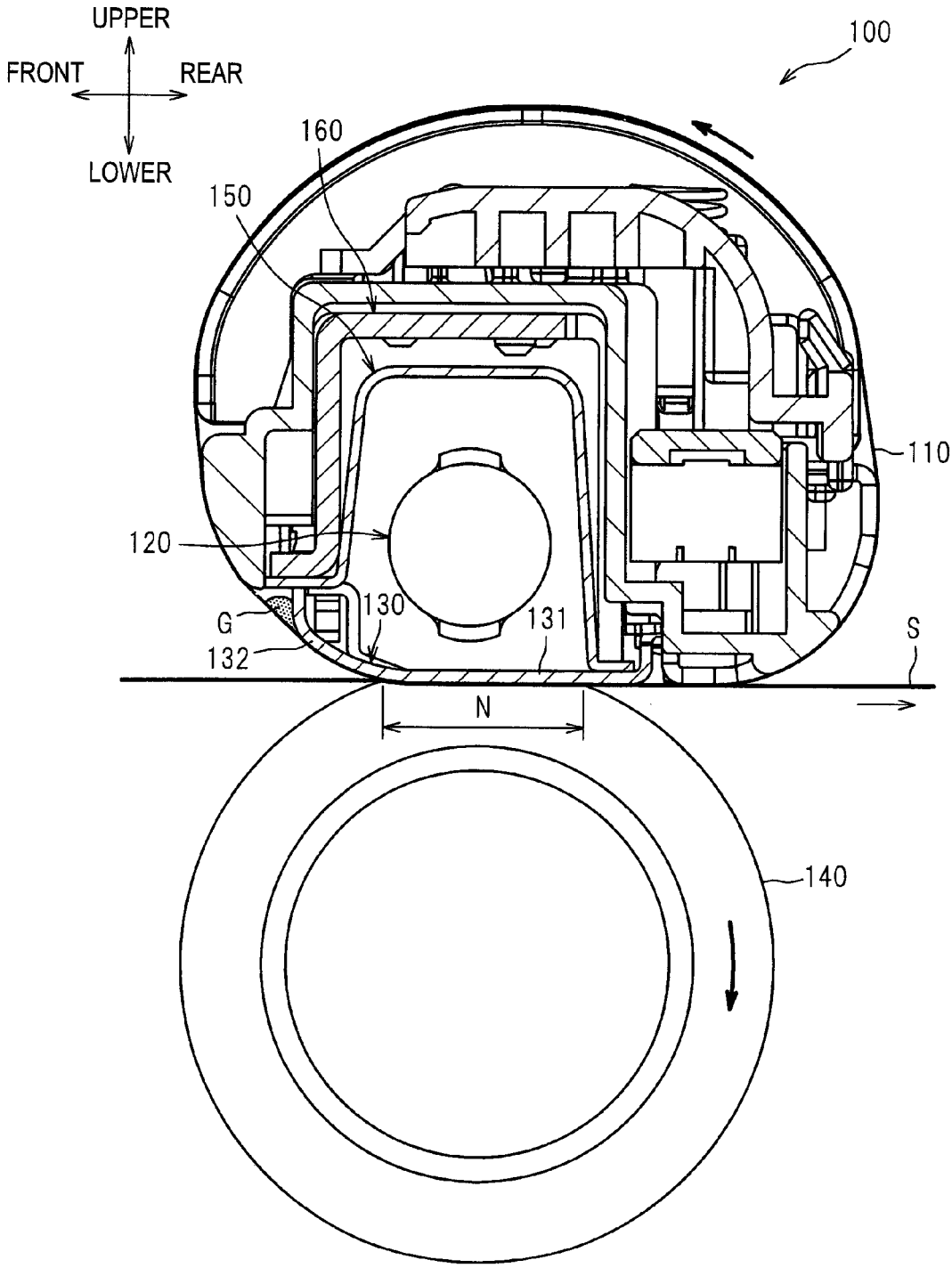
FIG. 2 is a cross-sectional view illustrating a fixing device.

As shown in FIG. 2, the fixing device 100 includes a nip plate 130 and a fixing belt 110 as an example of a heating member, a halogen lamp 120 as an example of a heat source, a pressing roller 140 as an example of a backup member, a reflective plate 150, and a stay 160.

The fixing belt 110 is an endless (cylindrical) belt made of stainless steel and having heat resistance and flexibility. Inside the fixing belt 110, the halogen lamp 120, the nip plate 130, the reflective plate 150, and the stay 160 are provided.

The halogen lamp 120 is a member which emits radiant heat to heat the nip plate 130 (a nip member) and the fixing belt 110 (a nip portion N), thereby heating the toner on the sheet S. The halogen lamp 120 is disposed with a predetermined gap from the inner surface of the nip plate 130.

The nip plate 130 is a plate-shaped member which receives the radiant heat from the halogen lamp 120, and it is disposed such that the lower surface of the nip plate 130 is in sliding contact with the inner circumferential surface of the fixing belt 110. In the present illustrative embodiment, the nip plate 130 is made of a metal. For example, the nip plate 130 is formed by bending an aluminum plate having heat conductivity higher than that of the stay 160 made of steel (to be described below). In the case of making the nip plate 130 of aluminum, it is possible to improve the heat conductivity of the nip plate 130.

Figure 3:
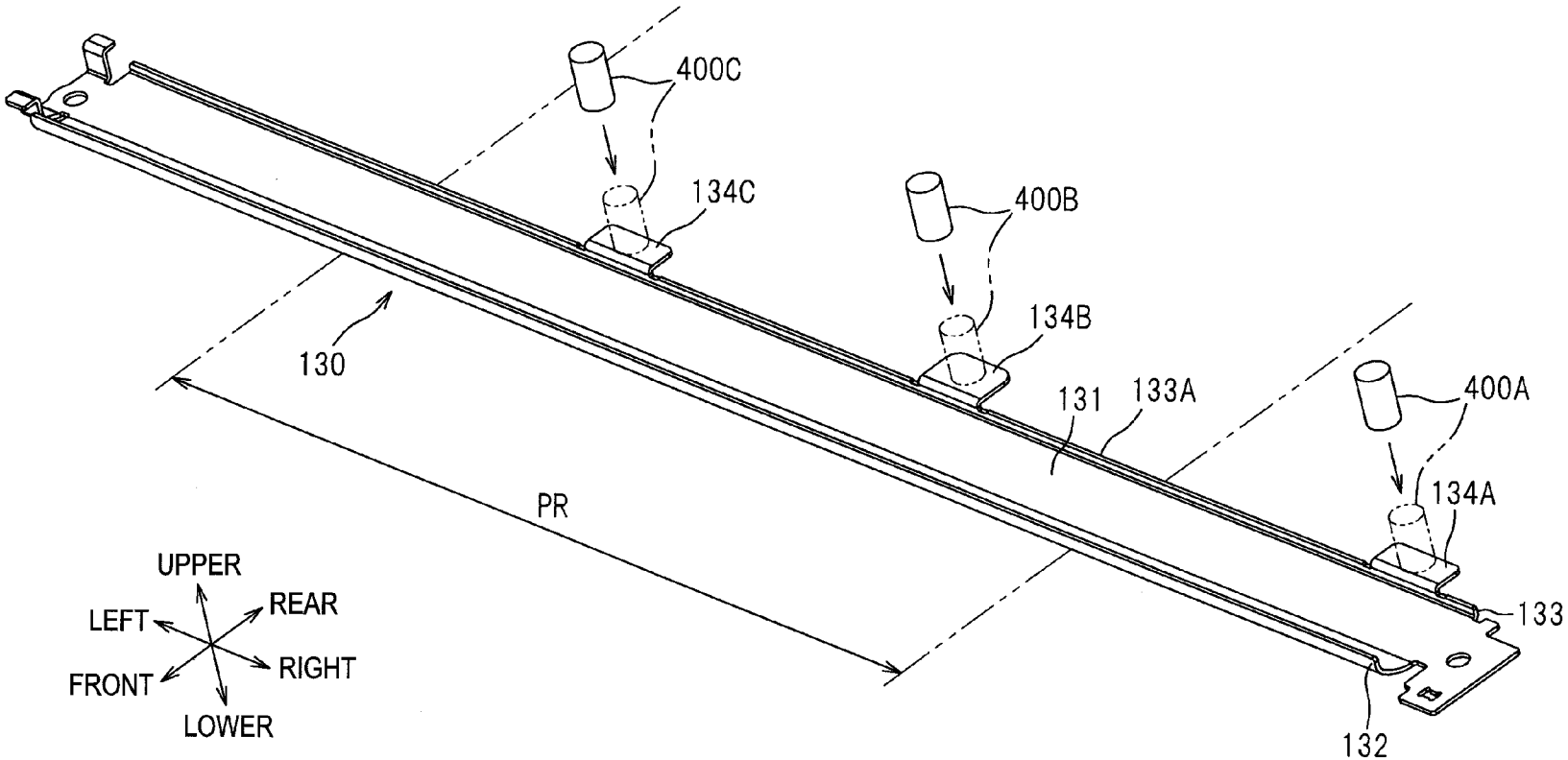
FIG. 3 is a perspective view illustrating a nip plate and a temperature sensor.

As shown in FIGS. 2 and 3, the nip plate 130 includes a plate-like portion 131, a front bent portion 132, a rear bent portion 133, and three detection target portions 134.

The plate-like portion 131 is an elongated plate-like member which is perpendicular to a upper-lower direction and is long in a left-right direction, and the fixing belt 110 is sandwiched between the plate-like portion 131 and the pressing roller 140 in the upper-lower direction, so that the nip portion N is formed between the plate-like portion 131 and the fixing belt 110. Further, the plate-like portion 131 is disposed below the halogen lamp 120, and it is configured to transfer heat from the halogen lamp 120 to the toner on the sheet S through the fixing belt 110.

Also, on the inner surface (upper surface) of the plate-like portion 131, painting may be performed in black, or a heat absorbing member may be provided. In this case, it is possible to efficiently absorb the radiant heat from the halogen lamp 120.

The front bent portion 132 is formed to be bent in an almost arc shape upward from the front end side (upstream side in a predetermined direction) of the plate-like portion 131 to be disposed to face the halogen lamp 120. Therefore, the front bent portion 132 is directly heated by the halogen lamp 120. As a result, it is possible to heat (preheat) the sheet S having not entered the nip portion N, in advance, by the front bent portion 132, so that it is possible to improve a thermally fixing characteristic.

The rear bent portion 133 is formed to extend from the rear end edge of the plate-like portion 131 toward the upper side (the radially inner side of the fixing belt 110). Specifically, the rear bent portion 133 is formed to extend from one end side of the rear end edge of the plate-like portion 131 to the other end side in the left-right direction. Therefore, it is possible to use the rear bent portion 133 to effectively suppress lubricant G attached to the inner circumferential surface of the fixing belt 110 from flowing onto the upper surface of the plate-like portion 131 (for example, a surface painted in black). As a result, it is possible to suppress a reduction in the heating efficiency of the nip plate 130.

The three detection target portions 134A, 134B, and 134C are portions whose temperatures are detected by a side thermistor 400A, a thermostat 400B, and a center thermistor 400C, respectively. The three detection target portions 134A, 134B, and 134C are formed to extend from portions of the upper end edge 133A of the rear bent portion 133 toward the rear side. Specifically, two detection target portions 134B and 134C are disposed almost at the center portion of the rear bent portion 133 extending in the left-right direction, and one detection target portion 134A is disposed at one end portion on the outer side of the rear bent portion 133 in the left-right direction.

Also, as shown in FIG. 3, the detection target portions 134B and 134C are disposed inside a minimum sheet passage range PR in the left-right direction, and the detection target portion 134A is disposed outside the minimum sheet passage range PR in the left-right direction. Here, the minimum sheet passage range PR indicates a passage range of sheet having the minimum width in the left-right direction, within sheet which can be used in the laser printer 1.

Here, the side thermistor 400A and the center thermistor 400C are temperature sensors for transmitting detected temperatures to a control device 510 (controller), and the thermostat 400B is a thermal switch for mechanically cutting electricity to the halogen lamp 120 if a detected temperature exceeds a predetermined temperature.

Additionally, the side thermistor 400A may be a contact type thermistor for coming into contact with the detection target portion 134A so as to detect the temperature of the detection target portion 134A, or may be a non-contact type thermistor for detecting the temperature of the detection target portion 134A without coming into contact with the detection target portion 134A.

Similarly, the center thermistor 400C may be a contact type thermistor for coming into contact with the detection target portion 134C so as to detect the temperature of the detection target portion 134C, or may be a non-contact type thermistor for detecting the temperature of the detection target portion 134C without coming into contact with the detection target portion 134C.

The pressing roller 140 is a member to sandwich the fixing belt 110 between the pressing roller 140 and the nip plate 130, thereby forming the nip portion N between the pressing roller 140 and the fixing belt 110, and it is disposed below the nip plate 130. Further, in order to form the nip portion N, one of the nip plate 130 and the pressing roller 140 is biased toward the other. Furthermore, the pressing roller 140 is configured to rotate by a driving force transmitted from a motor 500 (see FIG. 1) provided inside the main body casing 2, and it is configured to rotate together with the fixing belt 110 in a state where the fixing belt 110 and the sheet S are sandwiched between the pressing roller 140 and the nip plate 130, thereby conveying the sheet S toward the rear side.

The reflective plate 150 is a member which reflects the radiant heat from the halogen lamp 120 toward the nip plate 130, and it is disposed inside the fixing belt 110 so as to surround the halogen lamp 120 with predetermined gaps from the halogen lamp 120. The reflective plate 140 is formed by bending, for example, an aluminum plate having high reflectivity for infrared rays and far infrared rays, almost in a U shape in a cross-sectional view.

The stay 160 is a member which supports the nip plate 130 through the reflective plate 150 and receives a load from the pressing roller 140 to surround the halogen lamp 120 and the reflective plate 150 inside the fixing belt 110. Here, it is assumed that the load is corresponding to a reaction force to the force of the nip plate 130 biasing the pressing roller 140 in the configuration where the nip plate 130 biases the pressing roller 140. This stay 160 is formed by bending a material having relatively high rigidity, for example, a steel plate.

The halogen lamp 120, a motor 500 for driving the pressing roller 140, and the like of the fixing device 100 configured as described above are configured to be controlled by the control device 510 shown in FIG. 1. Also, the motor 500 is configured to supply a driving force to the pressing roller 140 through a gear mechanism (not shown), to supply driving forces even to the developing roller 71, the feeding roller 72, and the agitator 75 through another gear mechanism (not shown), and to supply a driving force to the sheet feeding unit 33 through another gear mechanism (not shown). In other words, if the motor 500 is driven, the pressing roller 140, the developing roller 71, the feeding roller 72, the agitator 75, and the sheet feeding unit 33 are driven at the same time.

<Control Device>

Now, the control device 510 (controller) will be described in detail.

As shown in FIG. 1, the control device 510 includes, for example, a CPU, a RAM, a ROM, and an input/output circuit, and performs arithmetic processing based on inputs from the above-mentioned center thermistor 400C and side thermistor 400A, the contents of a print instruction, programs and data stored in the ROM, and the like, thereby controlling the halogen lamp 120 and the motor 500 (the sheet feeding unit 33). Also, a temperature sensor to be used for the below control is the center thermistor 400C, but it may be the side thermistor 400A.

The control device 510 is configured to turn on the halogen lamp 120 if receiving a print instruction, and turn off the halogen lamp 120 from when the print control terminates to when the next print instruction is received. In other words, the control device 510 is basically configured not to supply electric power to the halogen lamp 120 from when the print control terminates to when the next print instruction is received. In other words, the control device 510 is basically configured not to supply electric power to the halogen lamp 120 on a standby mode, like a sleep mode.

The control device 510 has a function of comparing the temperature gradient of the nip plate 130 for a predetermined period from the print-instruction receiving time, with the first threshold value or the second threshold value, thereby determining the sheet feeding timings of the first, second, and subsequent sheets S. Further, the control device 510 is configured to change the respective threshold values according to the temperature of the nip plate 130 at the print-instruction receiving time.

Also, the sheet feeding timings may be timings to feed the sheets S from the sheet feed tray 31 by the sheet feeding roller 33A, and may be timings to feed the sheets S by the registration roller 33E, which have been temporarily stopped by the registration roller 33E.

Figure 4:
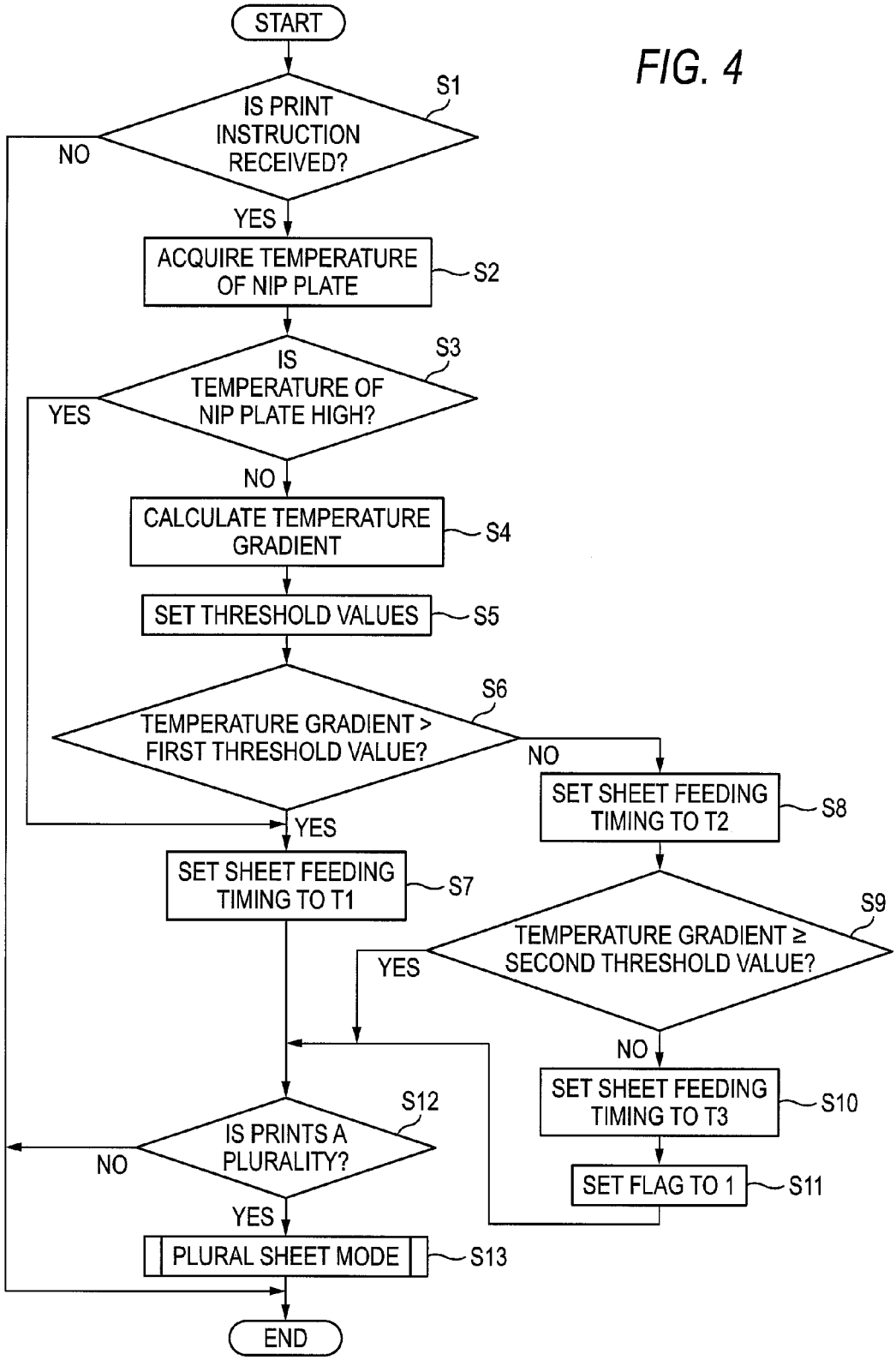
FIG. 4 is a flow chart illustrating sheet feed control.
Figure 5:
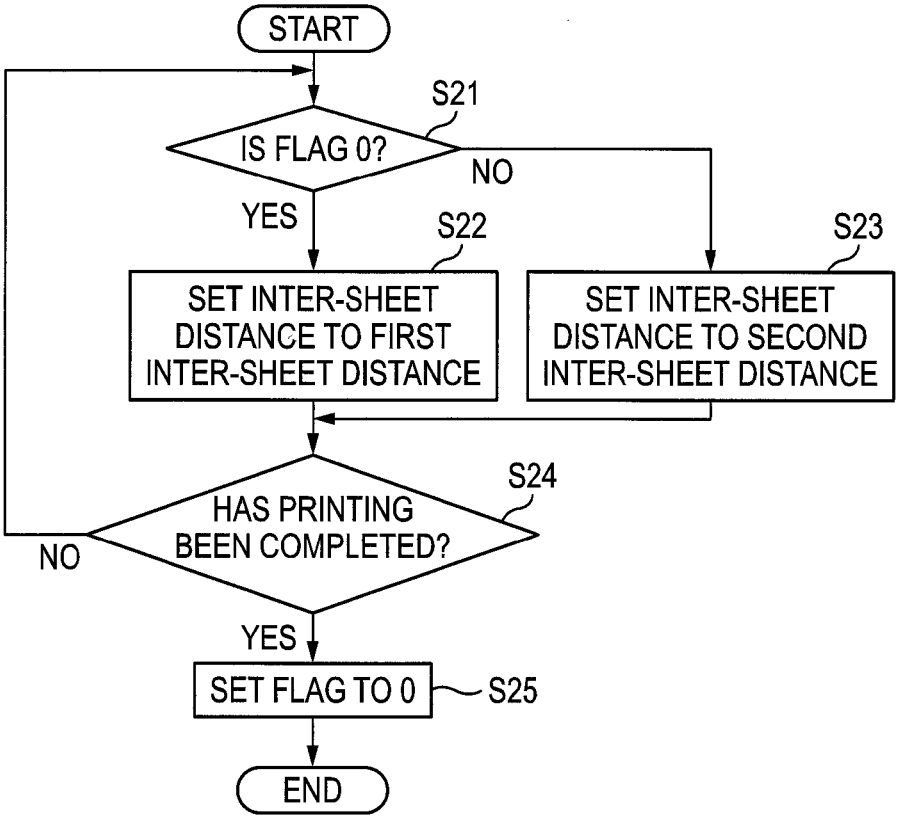
FIG. 5 is a flow chart illustrating a plural sheet mode.

Specifically, the control device 510 performs control according to flow charts shown in FIGS. 4 and 5. While the power source of the laser printer 1 is turned on, the control device 510 always performs sheet feed control shown in FIG. 4.

In the sheet feed control shown in FIG. 4, first, the control device 510 determines whether any print instruction has been received (step S1). In a case where any print instruction has not been received in step S1 (No), the control device 510 terminates the present control, and in a case where a print instruction has been received in step S1 (Yes), the control device 510 acquires the temperature of the nip plate 130 detected by the center thermistor 400C (step S2).

Figures 6, 7:
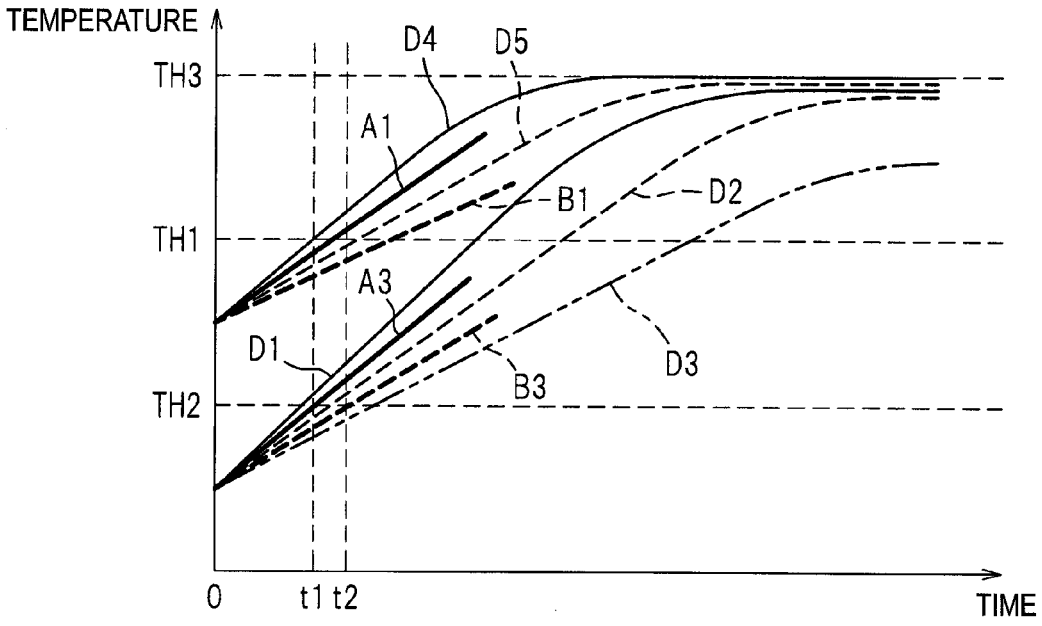
FIG. 6 is a view illustrating respective maps for setting a first threshold value and a second threshold value.
FIG. 7 is a graph illustrating the relation between a temperature gradient and the respective threshold values.

After step S2, the control device 510 determines whether the temperature of the nip plate 130 (the temperature acquired in step S2) is a high temperature, specifically (step S3), whether the temperature of the nip plate 130 is equal to or higher than a predetermined first temperature TH1 (see FIG. 7). Here, the first temperature TH1 is a temperature from which the nip plate 130 can be reach a fixing temperature TH3 while a sheet S fed from the sheet feeding unit 33 at a first timing T1 (at the most early timing) which will be described reaches the nip plate 130, and it is appropriately set by experiments and the like.

In a case where the temperature of the nip plate 130 is not a high temperature in step S3 (No), the control device 510 calculates a temperature gradient based on the temperature acquired in step S2 (step S4). Specifically, for example, the control device 510 calculates the temperature gradient based on the temperatures detected at different times t1 and t2 (see FIG. 7) after a predetermined period from the print-instruction receiving time.

After step S4, the control device 510 sets respective threshold values (the first threshold value and the second threshold value) for determining the sheet feeding timing (step S5). Specifically, in step S5, the control device 510 sets the respective threshold values based on maps shown in FIG. 6.

Here, values in FIG. 6 satisfy magnitude relations of A1<A2<A3<A4 and B1<B2<B3<B4. Also, the second threshold value is a value smaller than the first threshold value.

Specifically, A1>B1, A2>B2, A3>B3, and A4>B4 are satisfied. Also, 'MEDIUM TEMPERATURE' and 'LOW TEMPERATURE' shown in each map represent the temperature state of the nip plate 130.

If the temperature of the nip plate 130 is lower than the above-mentioned first temperature TH1 and is equal to or higher than the second temperature TH2 (see FIG. 7), the control device 510 determines that the temperature of the nip plate 130 is a medium temperature, and refers to sections 'MEDIUM TEMPERATURE' in the maps. Also, if the temperature of the nip plate 130 is lower than the second temperature TH2, the control device 510 determines that the temperature of the nip plate 130 is a low temperature, and refers to sections 'LOW TEMPERATURE' in the maps. The second temperature TH2 is appropriately set by experiments and the like.

Also, 'HIGH ROTATION' and 'LOW ROTATION' shown in the maps represent the rotation speed of the motor 500. Then, in a case of controlling the motor 500 at a high rotation speed, the control device 510 refers to sections 'HIGH ROTATION' in the maps, and in a case of controlling the motor 500 at a low rotation speed, the control device 510 refers to sections 'LOW ROTATION' in the maps.

Also, the control to change the rotation speed of the motor 500, and thus it will not be described in detail. As the control to change the rotation speed of the motor 500, it may be exemplified that control decrease the rotation speed as the thickness of the sheet S increases. Further, the laser printer 1 of the illustrative embodiment is configured to change the rotation speed of the motor 500, thereby changing the rotation speed (circumferential speed) of the pressing roller 140. However, this disclosure is not limited to that configuration. In other words, in this disclosure, the laser printer 1 may be configured to switch the gear ratio of a gear mechanism for transmitting the driving force of the motor 500 to the pressing roller 140, thereby changing the rotation speed (circumferential speed) of the pressing roller 140.

Also, the respective maps for setting the respective threshold values are set such that the numeral values of the sections 'MEDIUM TEMPERATURE' are smaller than the numeral values of the sections 'LOW TEMPERATURE' and such that the numeral values of the sections 'HIGH ROTATION' are smaller than the numeral values of the sections 'LOW ROTATION'.

Therefore, the control device 510 is configured to change the first threshold value to a smaller value (for example, from A3 to A1) as the temperature of the nip plate 130 at the print-instruction receiving time (the temperature acquired in step S2) increases, and to change the first threshold value to a smaller value (for example, from A2 to A1) as the rotation speed of the motor 500 increases. Also, the control device 510 is configured to change the second threshold value to a smaller value (for example, from B3 to B1) as the temperature of the nip plate 130 at the print-instruction receiving time increases, and to change the second threshold value to a smaller value (for example, from B2 to B1) as the rotation speed of the motor 500 increases.

After setting the respective threshold values as described above, the control device 510 proceeds to the process of step S6 shown in FIG. 4 so as to determine whether the temperature gradient is larger than the first threshold value. In a case where the temperature gradient is larger than the first threshold value in step S6 (Yes) or in a case where the temperature of the nip plate 130 is a high temperature in step S3 (Yes), the control device 510 sets the first sheet feeding timing of the sheets S to the first timing T1 (step 7).

In a case where the temperature gradient is equal to or less than the first threshold value in step S6 (No), the control device 510 sets the first sheet feeding timing of the sheets S to a second timing T2 later than the first temperature TH1 (step S8). After step S8, in step S9, the control device 510 determines whether the temperature gradient is equal to or larger than the second threshold value smaller than the first threshold value.

In a case where the temperature gradient is smaller than the second threshold value in step S9 (No), the control device 510 sets the first sheet feeding timing to a third timing T3 later than the second timing T2 (step S10). In other words, in step S10, the control device 510 rewrites the second timing T2 set in step S8 with the third timing T3.

After step S10 the control device 510 sets a flag to 1 (step S11). Therefore, in a plural sheet mode to be described below, it is possible to perform control to lengthen a period from the sheet feeding timing of the first sheet S to the sheet feeding timing of the second sheet S, as compared to a case where the temperature gradient is equal to or larger than the second threshold value (a case where the detection result of step S8 is 'Yes'). Also, the period from the sheet feeding timing of the first sheet S to the sheet feeding timing of the second sheet S corresponds to an inter-sheet distance from the first sheet S to the second sheet S, and thus will be referred to as the inter-sheet distance for the sake of convenience in the following description.

After step S11 or in a case where the detection result of step S9 is 'Yes', the control device 510 determines whether the number of prints designated by the print instruction is a plurality or not (step S12). In a case where the number of prints is a plurality in step S12 (Yes), the control device 510 performs the plural sheet mode (step S13), and in a case where the number of prints is 1 in step S12 (No), the control device 510 terminates the present control.

As shown in FIG. 5, in the plural sheet mode, control device 510 determines whether the flag is 0 (step S21). In a case where the flag is 0 in step S21, that is, in a case where the temperature gradient is equal to or larger than the second threshold value (Yes), the control device 510 sets the inter-sheet distance to a first inter-sheet distance (step S22).

In a case where the flag is 1 in step S21, that is, in a case where the temperature gradient is smaller than the second threshold value (No), the control device 510 sets the inter-sheet distance to a second inter-sheet distance longer than the first inter-sheet distance (step S23). In other words, even in a case where the temperature gradient is equal to or larger than the second threshold value, the control device 510 lengthens the period from the sheet feeding timing of the previous (for example, first) sheet S to the sheet feeding timing of the current (for example, second) sheet S.

After step S22 or S23, the control device 510 determines whether the print control corresponding to the multiple sheets has been completed (step S24). In a case where the print control has not been completed in step S24 (No), the control device 510 returns to the process of step S21.

Meanwhile, in a case where the print control has been completed in step S24 (Yes), the control device 510 sets the flag to 0, and terminates the present control.

Now, an example of a specific method of determining the sheet feeding timing by the control device 510 will be described with reference to FIG. 7. An example of FIG. 7 represents an example in which the rotation speed of the motor 500 is high and constant.

As shown in FIG. 7, in a case where the temperature of the nip plate 130 at the print-instruction receiving time (a time point when the time axis is 0) is lower than the second temperature TH2 (a low temperature), the control device 510 sets the first threshold value to A3 and sets the second threshold value to B3. In this case, if the temperature gradient of the nip plate 130 is D1, the control device 510 sets the sheet feed timing to the first timing T1, and sets the inter-sheet distance to the first inter-sheet distance.

Also, in a case where the temperature gradient is D2, the control device 510 sets the sheet feed timing to the second timing T2, and sets the inter-sheet distance to the first inter-sheet distance. Further, in a case where the temperature gradient is D3, the control device 510 sets the sheet feed timing to the third timing T3, and sets the inter-sheet distance to the second inter-sheet distance.

Meanwhile, in a case where the temperature of the nip plate 130 at the print-instruction receiving time is equal to or higher than the second temperature TH2 and is lower than the first temperature TH1 (a medium temperature), the control device 510 sets the first threshold value to A1 smaller than A3, and sets the second threshold value to B1 smaller than B3. In other words, during a medium temperature, the temperature gradient is gentler than that during a low temperature, and according to this, the respective threshold values are set to be smaller.

In this case, if the temperature gradient of the nip plate 130 is D4, the control device 510 sets the sheet feeding timing to the first timing T1, and sets the inter-sheet distance to the first inter-sheet distance. Also, if the temperature gradient is D5, the control device 510 sets the sheet feeding timing to the second timing T2, and sets the inter-sheet distance to the first inter-sheet distance.

Also, in a case where the temperature of the nip plate 130 at the print-instruction receiving time is equal to or higher than the first temperature TH1 (high temperature), the control device 510 sets the sheet feeding timing to the first timing T1, and sets the inter-sheet distance to the first inter-sheet distance.

According to the above-mentioned configuration, it is possible to obtain the following effects in the present illustrative embodiment.

Respective threshold values are changed to a smaller value according to a phenomenon in which the temperature gradient of the nip plate 130 is reduced as the temperature of the nip plate 130 at the print-instruction receiving time increases. Therefore, it is possible to compare the temperature gradient of the nip plate 130 with respective appropriate threshold values, and it is possible to set the sheet feeding timings of the sheets S to appropriate timings.

If the rotation speed of the motor 500 is high, the pressing roller 140 take a lot of heat of the nip plate 130, and the temperature gradient of the nip plate 130 decreases. In response to this, each threshold value is changed. Therefore, it is possible to set the sheet feeding timings of the sheets S to appropriate timings.

Also, this disclosure is not limited to the above-mentioned illustrative embodiment, but it may be used in various forms as exemplified below.

In the above-mentioned illustrative embodiment, the halogen lamp 120 (the heat source) and the sheet feeding unit 33 (the sheet feeding unit) are controlled by one control device 510. However, this disclosure is not limited thereto. A control device for controlling the heat source and a control device for controlling the sheet feeding unit may be separately provided.

In the above-mentioned illustrative embodiment, the halogen lamp 120 has been exemplified as an example of the heat source. However, this disclosure is not limited thereto. The heat source may be, for example, a heat element, an IH heat source, or the like. Here, the IH heat source refers to a heat source which does not produce heat by itself, but it makes a roller or a metal belt produce heat according to an electromagnetic-induction heating scheme.

In the above-mentioned illustrative embodiment, as an example of the heating member, the fixing belt 110 and the nip plate 130 have been exemplified. However, this disclosure is not limited thereto. For example, the heating member may be a heating roller which is a metal tube thicker than the fixing belt 110.

In the above-mentioned illustrative embodiment, this disclosure has been applied to the laser printer 1. However, this disclosure is not limited thereto. This disclosure may be applied to other image forming apparatuses, for example, copy machines, multi-function apparatuses, and so on.

In the above-mentioned illustrative embodiment, as an example of the recording sheet, the sheets S such as thick sheet, card, and thin sheet have been used. However, this disclosure is not limited thereto. For example, the recording sheet may be an OHP sheet.

In the above-mentioned illustrative embodiment, as the backup member, the pressing roller 140 has been exemplified. However, this disclosure is not limited thereto. For example, the rotating member may be a belt-like pressing member, or the like.

In the above-mentioned illustrative embodiment, as an example of the nip member, the nip plate 130 has been exemplified. However, this disclosure is not limited thereto. For example, the nip member may be a thick member which is not a plate shape.

In the above-mentioned illustrative embodiment, the pressing roller 140 (the backup member) is rotated by the motor 500. However, this disclosure is not limited thereto. The motor needs only to rotate at least one of the rotating member and the heating member. For example, in a case where the heating member is the heating roller, the heating roller may be driven by the motor.

In the above-mentioned illustrative embodiment, the control device 510 controller determines the sheet feeding timings. However, this disclosure is not limited thereto. The feeding timings may be set as feeding intervals. For example, the first timing T1 may be corresponding to a first interval and the second timing T2 may be corresponding to a second interval.

Additionally, the heating member may includes, an endless belt having an inner surface defining an inner space; and a nip member disposed at the inner space of the endless belt and configured to pinch the endless belt between the nip member and the rotating member.

What is claimed is:

1. An image forming apparatus comprising:

a fixing device including:

a heating member;

a heat source configured to heat the heating member;

a rotating member configured to rotate and to be in contact with the heating member; and a temperature sensor configured to detect the temperature of the heating member, a sheet feeding unit configured to feed a recording sheet toward the fixing device; and a control device configured to control the heat source and the sheet feeding unit, wherein the control device is configured to perform a sheet feed control:

in which the feeding timing of a first recording sheet by the sheet feeding unit is set to a first timing if a temperature gradient of the heating member for a predetermined period from a print-instruction receiving time is larger than a first threshold value; and in which the feeding timing of the first recording sheet by the sheet feeding unit is set to a second timing later than the first timing if a temperature gradient of the heating member for the predetermined period is equal to or less than the first threshold value, and wherein, in the sheet feed control, the control device changes the first threshold value to a smaller value as the temperature of the heating member at the print-instruction receiving time increases.

2. The image forming apparatus according to claim 1, wherein, in a case where a temperature gradient of the heating member is smaller than a second threshold value smaller than the first threshold value, the control device performs a control, in which the feeding timing of a first recording sheet by the sheet feeding unit is set to a third timing later than the second timing and a period from the feeding timing of the first recording sheet to a feeding timing of a second recording sheet is lengthened as compared to a case where a temperature gradient is equal to or larger than the second threshold value, and wherein the control device changes the second threshold value to a smaller value as the temperature of the heating member at the print-instruction receiving time increases.

3. The image forming apparatus according to claim 1, further comprising:

a motor configured to drive at least one of the rotating member and the heating member, wherein the control device changes the first threshold value to a smaller value as a rotation speed of the rotating member increases.

4. The image forming apparatus according to claim 2, further comprising:

a motor configured to drive at least one of the rotating member and the heating member, wherein the control device changes the second threshold value to a smaller value as a rotation speed of the rotating member increases.

5. The image forming apparatus according to claim 1, wherein the heating member includes a cylindrical fixing belt that surrounds the heat source, and wherein a nip member sandwiches the fixing belt with the rotating member.

6. The image forming apparatus according to claim 1, wherein the control device turns on the heat source if receiving a print instruction, and wherein the control device controls the heat source to be turned off from when the sheet feed control is completed to when the next print instruction is received.

7. An image forming apparatus comprising:

a fixing device including:

a heating member;

a heat source configured to heat the heating member;

a rotating member configured to rotate and to be in contact with the heating member; and a sensor configured to detect a temperature of the heating member, a sheet feeding unit configured to feed a recording sheet toward the fixing device; and a controller for feeding a sheet by the sheet feeding unit, upon feeding a sheet by the sheet feeding unit in response to receiving a print-instruction, is configured to:

wait for a first interval before feeding a sheet if a gradient of the temperature detected by the sensor upon receiving a print-instruction is greater than a first threshold value;

wait for a second interval longer than the first interval before feeding a sheet if a gradient of the temperature detected by the sensor upon receiving a print-instruction is equal to or smaller than the first threshold value; and set the first threshold value based on the temperature detected by the sensor upon receiving a print-instruction.

8. The image forming apparatus according to claim 7, wherein the controller, upon feeding a sheet by the sheet feeding unit in response to receiving a print-instruction and upon setting the first threshold value, is configured to:

set the first threshold value to a first value if the temperature detected by the sensor upon receiving a print-instruction is a first temperature; and set the first threshold value to a second value smaller than the first value if the temperature detected by the sensor upon receiving a print-instruction is a second temperature higher than the first temperature.

9. The image forming apparatus according to claim 7, wherein, the controller, upon feeding a sheet by the sheet feeding unit in response to receiving a print-instruction, is configured to wait for a third interval longer than the second interval before feeding a sheet if a gradient of the temperature detected by the sensor upon receiving a print-instruction is equal or smaller than a second threshold value smaller than the first threshold.

10. The image forming apparatus according to claim 7, further comprising:

a motor configured to drive the rotating member, wherein the controller changes a rotation speed of the rotating member between a first speed and a second speed higher than the first speed, wherein, the controller, upon feeding a sheet by the sheet feeding unit in response to receiving a print-instruction, is configured to set the first threshold value based on the rotation speed of the rotating member.

11. The image forming apparatus according to claim 10, wherein the controller, upon feeding a sheet by the sheet feeding unit in response to receiving a print-instruction, is configured to:

set the first threshold value to a third value if the rotating member is driven at the first speed; and set the first threshold value to a fourth value smaller than the third value if the rotating member is driven at the second speed.

12. The image forming apparatus according to claim 1, wherein the heating member includes:

an endless belt including an inner surface defining an inner space; and a nip member disposed at the inner space and configured to pinch the endless belt with the rotating member.

13. The image forming apparatus according to claim 10, wherein the heating member includes:

an endless belt including an inner surface defining an inner space, and a nip member disposed at the inner space and configured to pinch the endless belt with the rotating member.

14. The image forming apparatus according to claim 11, wherein the heating member includes:

an endless belt including an inner surface defining an inner space, and a nip member disposed at the inner space and configured to pinch the endless belt with the rotating member.

15. The image forming apparatus according to claim 7, further comprising:

a motor configured to drive the heating member, wherein the controller changes a rotation speed of the heating member between a first speed and a second speed higher than the first speed, wherein, the controller, upon feeding a sheet by the sheet feeding unit in response to receiving a print-instruction, is configured to set the first threshold value based on the rotation speed of the heating member.

16. The image forming apparatus according to claim 15, wherein the controller, upon feeding a sheet by the sheet feeding unit in response to receiving a print-instruction, is configured to:

set the first threshold value to a third value if the heating member is driven at the first speed; and set the first threshold value to a fourth value smaller than the third value if the heating member is driven at the second speed.

17. The image forming apparatus according to claim 15, wherein the heating member is a roller.

18. The image forming apparatus according to claim 16, wherein the heating member is a roller.

19. The image forming apparatus according to claim 7, wherein the controller is configured to perform a sleep mode and a standby mode, wherein, in the standby mode, the controller does not supply the heat source with electric power.

* * * * *